US006162095A

United States Patent [19]

Holman

[11] Patent Number: 6,162,095

[45] Date of Patent: Dec. 19, 2000

[54] ELECTRICAL CONNECTION

[75] Inventor: Alan Edwin Lee Holman, High Wycombe, United Kingdom

[73] Assignee: Smiths Industries Public Limited Company, London, United Kingdom

[21] Appl. No.: 09/434,370

[22] Filed: Nov. 5, 1999

[51] Int. Cl.[7] ..... H01R 9/03

[52] U.S. Cl. ..... 439/610

[58] Field of Search ..... 439/610, 578, 439/579, 608, 101, 108, 321, 314, 95

[56] References Cited

U.S. PATENT DOCUMENTS

| | | | |
|---|---|---|---|
| 3,107,730 | 10/1963 | Hargett | 439/606 |
| 3,603,912 | 9/1971 | Kelly | 339/89 C |
| 4,243,290 | 1/1981 | Williams | 339/143 R |
| 4,423,919 | 1/1984 | Hillis | 339/143 R |
| 4,820,201 | 4/1989 | Van Brunt et al. | 439/610 |
| 5,366,383 | 11/1994 | Dearman | 439/321 |
| 5,449,302 | 9/1995 | Yarbrough et al. | 439/680 |
| 5,662,488 | 9/1997 | Alden | 439/314 |
| 5,807,138 | 9/1998 | Guiol | 439/610 |
| 5,871,371 | 2/1999 | Rothenberger et al. | 439/579 |
| 5,971,787 | 10/1999 | Brown | 439/321 |

FOREIGN PATENT DOCUMENTS 0 362 598 4/1990 European Pat. Off. .

*Primary Examiner*—Paula Bradley
*Assistant Examiner*—Phuong Chi Nguyen
*Attorney, Agent, or Firm*—Pollock, Vande Sande & Amernick, RLLP

[57] ABSTRACT

A connector backshell assembly has a metal-plated plastic cylinder with castellations at its rear end through the screens of cables are threaded. A cap embraces the castellations and has internal projections that project into recesses between the castellations. A coupling nut extends around the cylinder and bears against the rear end of the cap so that the cap is clamped onto the cylinder when the nut is screwed onto the rear of a connector. This clamps the screens between projections in the cap and the recesses in the cylinder so as to make electrical connection with the screens.

12 Claims, 3 Drawing Sheets

ELECTRICAL CONNECTION

BACKGROUND OF THE INVENTION

This invention relates to apparatus for making electrical connection to screening sleeves of electrical wires.

In electrical connectors and similar devices for use with screened electrical cables, it is often necessary to make electrical connection between the screening sleeves of the cables and a ground or other earthed member, such as a housing of the connector. It is important to ensure a high level of electrical continuity of the screens with the earthed member in order to provide effective electromagnetic screening and to protect against the effects of lightning strike. This can be difficult to achieve reliably where connection must be made to many such screens and where the screens must be readily removable for repair, inspection or maintenance.

BRIEF SUMMARY OF THE INVENTION

It is an object of the present invention to provide an alternative electrical connection.

According to the present invention, there is provided an electrical connection including a first annular member having a plurality of castellations around one end forming a plurality of recesses, a second annular member adapted to engage the one end of the first member, the second annular member having a plurality of projections shaped to extend within the recesses, at least one of the first and second members being electrically conductive, a third annular member being arranged to extend externally of the first member and to retain the second annular member against the first annular member such that screening sleeves on cables extending within the first member can be threaded through the recesses to extend between the outside of the first member and the inside of the third member and can be clamped in the recesses by the projections on the second member.

The second annular member preferably extends externally around the castellations, the projections being internally of the second member. The first and third members preferably engage a fourth member at an end opposite the castellations. The third member may have a screw thread arranged to engage a screw thread on the fourth member. The first member preferably has locking teeth at the end opposite the castellations arranged to engage locking teeth on the fourth member. The first annular member is preferably electrically conductive and may be of a plastics material having a layer of metal. The second annular member may be of a plastics material. The connection preferably includes a body contacting one end of the second annular member, the third annular member being rotatable on the body. The body and the one end of the second annular member may have cooperating locking teeth.

An electrical connector according to the present invention, will now be described, by way of example, with reference to the accompanying drawings.

DETAILED DESCRIPTION OF THE PREFERRED EMBODIMENT

Figure 1:
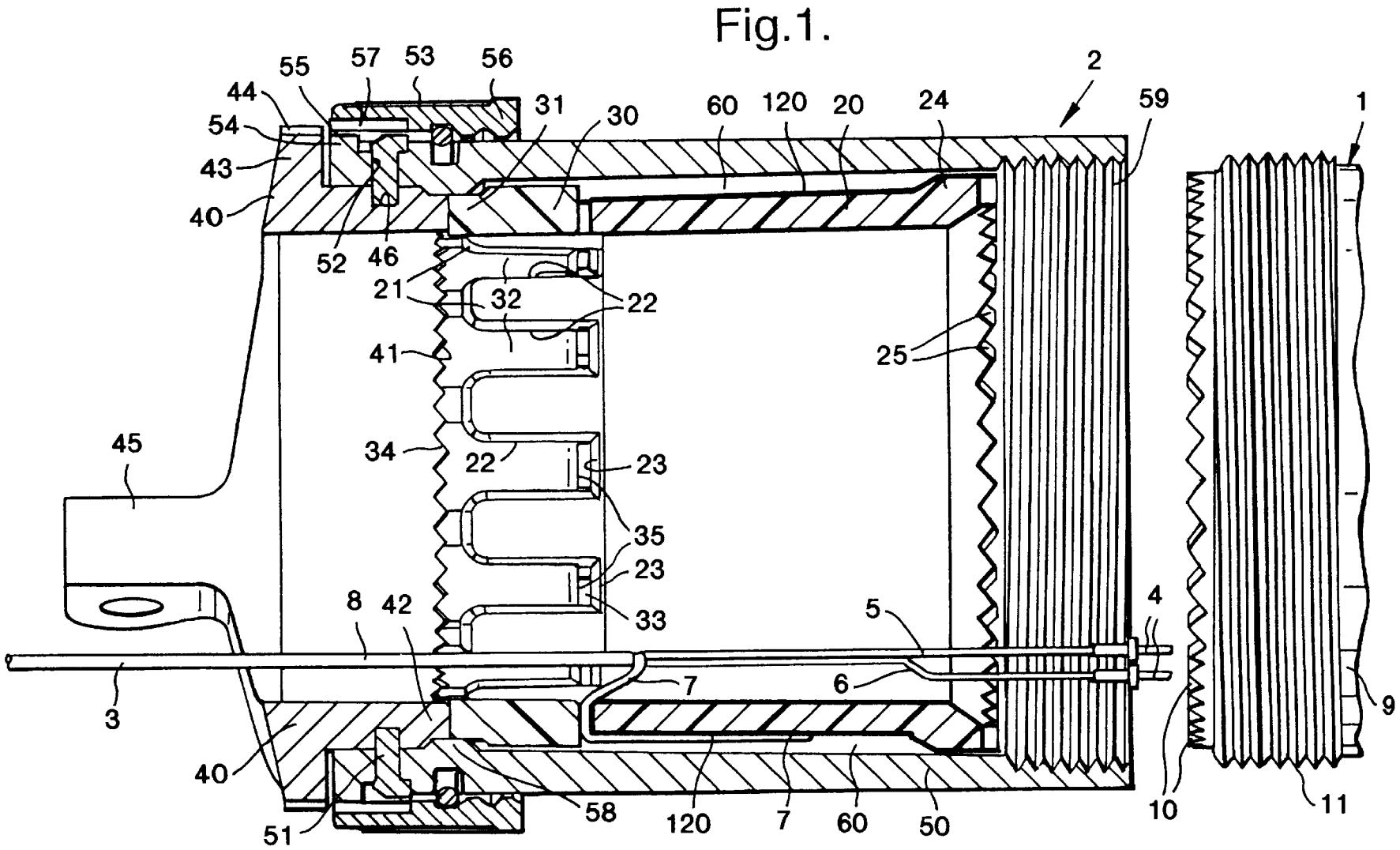
FIG. 1 is a sectional side elevation of the connector.
Figure 2:
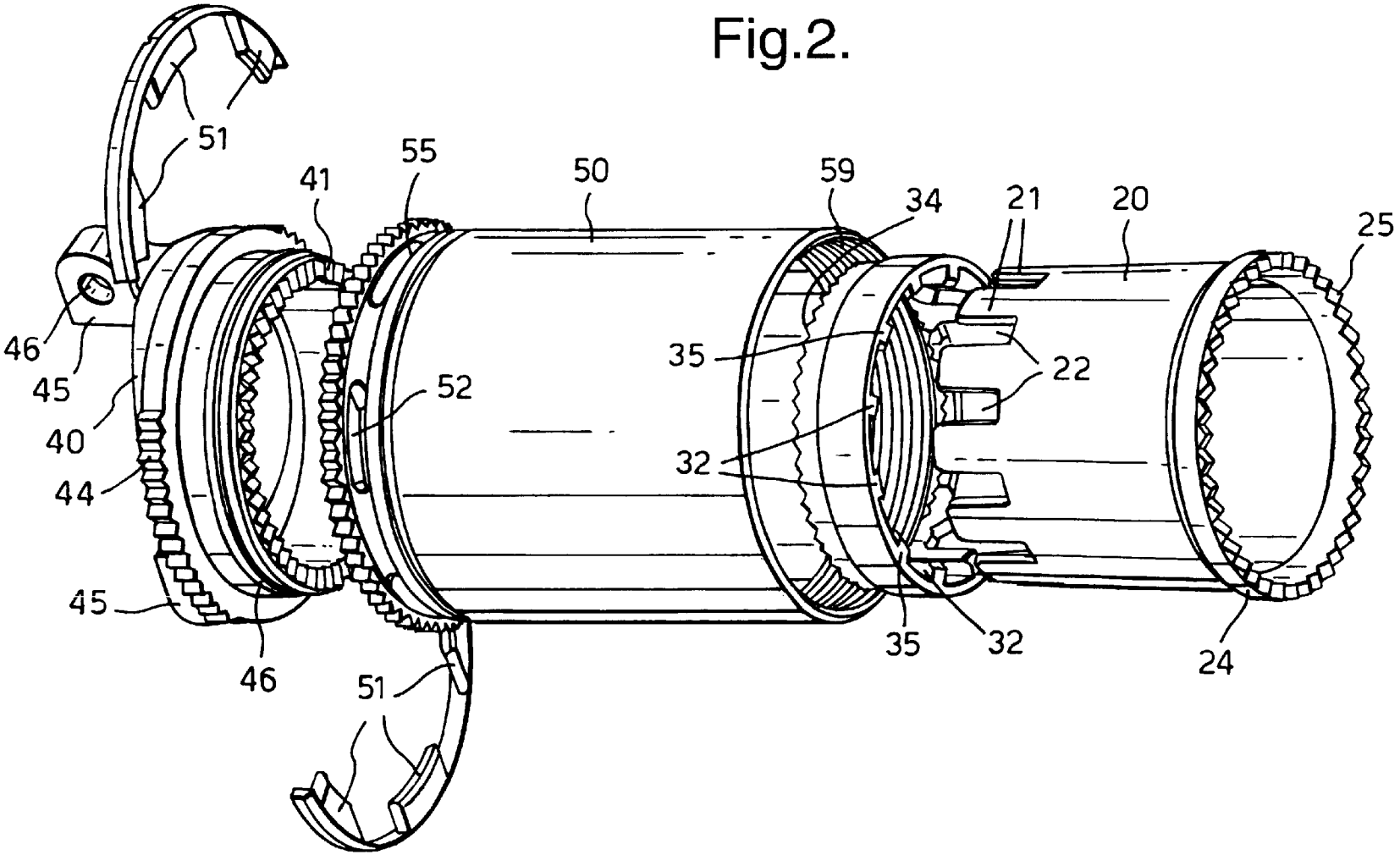
FIG. 2 is an exploded perspective view of the backshell of the connector without the locking ring.
Figure 3:
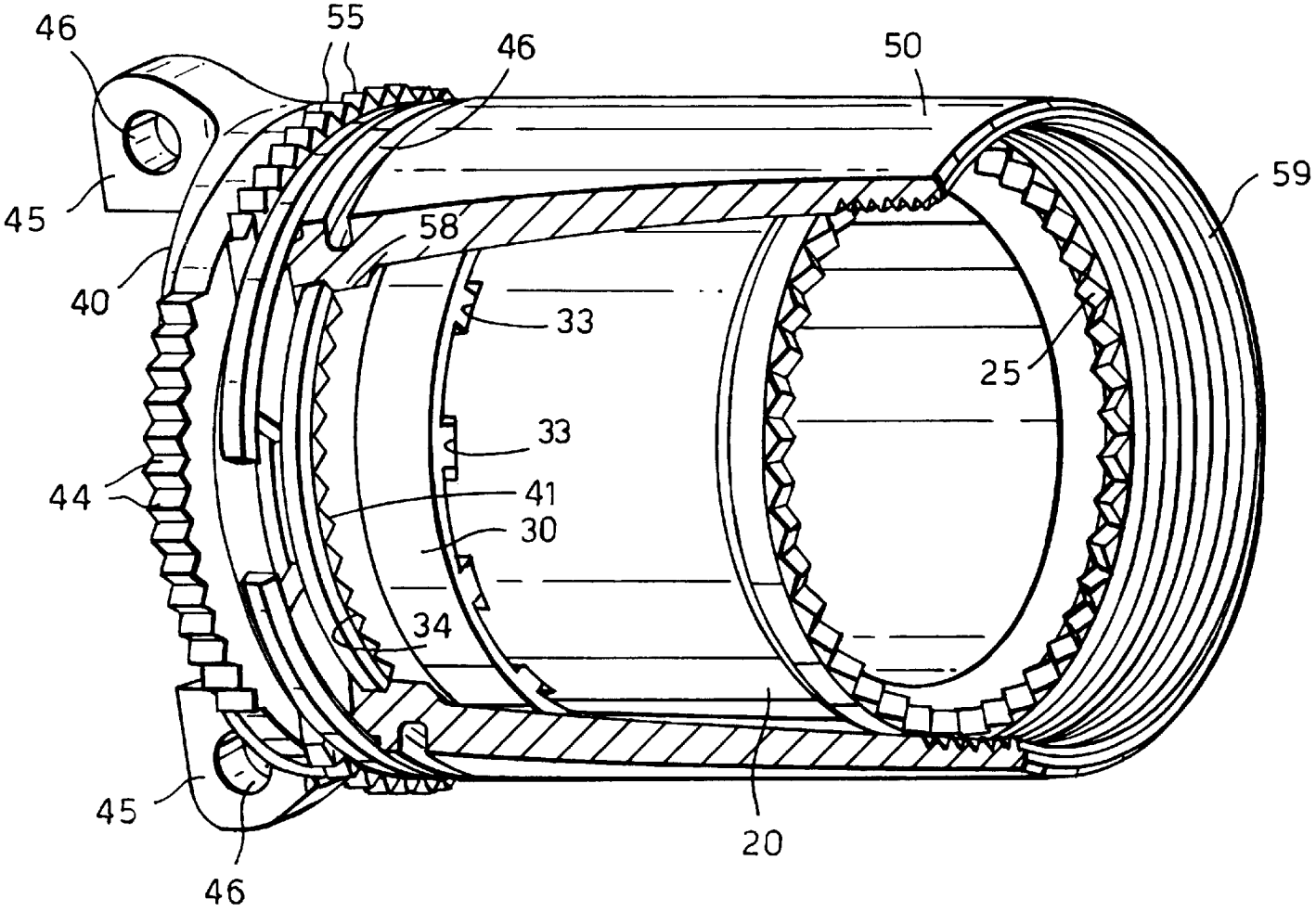
FIG. 3 is a cut-away perspective view of the backshell without the locking ring.

The connector comprises a front end assembly 1 of conventional form and a backshell assembly or accessory 2 mounted on the rear end of the mating accessory. A bundle of cables 3, only one of which is shown, extends through the backshell assembly 2, the cables making connection with contacts 4 mounted in the front end assembly 1. Each cable 3 comprises a twisted pair of two insulated wires 5 and 6 surrounded by a braided metal filament screening sleeve 7, which in turn is protected by an outer insulating jacket 8. The screening sleeves 7 of each cable 3 are electrically connected by the backshell assembly 2 with an outer metal shell 9 of the mating accessory 1.

The backshell assembly 2 has a first annular member or cylinder 20 moulded of a rigid plastics material and plated with a layer of metal 120 to make it electrically conductive. The cylinder 20 is formed at its rear end with twelve castellations 21 forming an equal number of recesses 22, each of which is of rectangular shape with a flat floor 23. The castellations 21 extend longitudinally in a rearwards direction. At its forward end, the cylinder 20 has a shallow, outwardly extending lip 24 formed with triangular locking teeth 25 around its forward end.

A second annular member or cap 30 engages the rear end of the cylinder 20. The cap 30 is moulded of a plastics material but need not be plated. Its outer diameter is approximately the same as that of the lip 24 on the cylinder 20 although at its rear end the diameter is reduced slightly to form a short neck 31. On its inner surface, the cap 30 is moulded with shallow projections 32, one for each recess 22 in the cylinder 20. The projections 32 are shaped to conform to the shape of the recesses 22 and the castellations 21, the projections each having a flat forward surface 35. The projections 32 engage the end of the castellations 21 to limit how far the cap 30 can be pushed over the rear end of the cylinder 20, such as to leave a small gap 33 at the bottom, or forward end, of the recesses 22. The rear end of the cap 30 is formed with triangular locking teeth 34.

The rear end of the cap 30 is engaged by the forward end of a ring-shape body 40, which has locking teeth 41 at its forward end engaging the teeth 34 on the cap. The teeth 41 are formed around a reduced diameter neck 42 at the forward end of the cap. At its rear end, the body 40 has an outwardly-projecting flange 43 having a series of longitudinally-extending splines 44 formed around its outer, curved surface, for a purpose that will be apparent later. The body also has two fastening members 45 with an aperture 46 at its rear end.

The backshell assembly 2 includes a third annular member or coupling nut 50 machined from a metal such as brass. The coupling nut 50 is mounted at its rear end on the body 40 and extends forwardly along the length of the backshell assembly 2, projecting beyond the forward end of the castellated cylinder 20. The coupling nut 50 is rotatably mounted on the body 40 by means of keys 51 projecting inwardly through slots 52 in the wall of the nut and engaging a groove 46 formed around the outside of the body. The coupling nut 50 carries a locking mechanism 53 of the kind described in GB 2270805, which serves to lock the nut against rotation on the body 40 at any desired angular position. The locking mechanism 53 includes an outwardly-projecting flange 54 at the rear end of the nut 50 having splines 55 corresponding to the splines 43 on the body 40. A locking ring 56 is mounted on the rear end of the nut 50, the ring having splines 57 formed around its inner surface at its rear end, which engage the splines 55 on the nut. The locking ring 56 is slidable on the nut 50 from a first, forward, unlocked position, as shown in FIG. 1, to a second, rear position where the ring projects over the flange 43 on the body and the splines 57 on the ring engage the splines 44 on the body 40.

On its inside surface, just forwardly of the slots 52, the coupling nut 50 has a shallow annular projection 58 positioned to locate with the neck 31 of the cap 30 and the neck 42 on the body 40. The nut 50 is cut with a screw thread 59 around its inner surface at its forward end. The internal diameter of the coupling nut 50 is sufficient for it to be a sliding fit on the lip 24 of the castellated cylinder 20 and on the cap 30, thereby leaving an annular gap 60 between the coupling nut 50 and the major part of the length of the cylinder.

To assemble the connector, the insulating jacket 8 is stripped from the cables 3 along a length of about 32 mm and the screening braid 7 is separated from each pair of wires 5 and 6. Contact pins 4 are then attached to the wires 5 and 6. The subassembly of the body 40 and the coupling nut 50 is threaded on the bundle of cables 3, followed by the cap 30 and cylinder 20, so that the wires 5 and 6 project through the forward end of the cylinder. The contact pins 4 on the wires 5 and 6 are terminated at the mating accessory 1. The cylinder 20 is threaded over the bundle of cables 3 and the exposed braids 7, which are placed in equal numbers around the recesses 22 of the cylinder. The cap 30 is then mated to the cylinder 20 so that the apportioned braids 7 are trapped between the flat surfaces 35 on the forward end of the projections 32 and on the floor 23 of the recesses 22. The emergent screens 7 fold forwardly where they emerge from the gaps 33 and extend along the outside of the cylinder 20 in the annular gap 60. The size of the gap 33 between the forward end of the cap 30 and the floor 23 of the recesses 22 is selected such that an effective clamping force is applied to the screens 7 when the cap is fully pushed onto the cylinder 20.

The forward end of the coupling nut 50 is brought up to the rear end of the accessory shell 9, which has triangular locking teeth 10 and an external screw thread 11. The coupling nut 50 is screwed onto the housing with the locking ring 56 in its forward, unlocked position, so that the nut can rotate freely on the body 40. When the teeth 25 on the cylinder 20 engage the teeth 10 on the shell 9, rotation of the cylinder and hence the cap 30 is prevented. Also, engagement of the teeth 34 on the cap 30 with the teeth 41 on the body 40 prevents rotation of the body. Further rotation of the coupling nut 50 applies an axial compressive force to the components of the backshell assembly 2 so that they clamp together, and the cap 30 and cylinder 20 clamp about the screens 7. When the coupling nut 50 is tightened sufficiently, the locking ring 56 is pushed rearwards to lock the nut with the body 40 and hence to lock the backshell assembly 2 in position on the connector shell 9.

The arrangement of the present invention enables connection to multiple screening sleeves to be made easily in a compact configuration. The backshell can be readily opened for inspection and maintenance. By making some of the components of plastics materials, the overall weight of the connector can be kept to a minimum and corrosion can be reduced. It also enables flexibility in design and reduces cost of manufacture. Because contact with the screening sleeves is by an axial clamping force applied between parts of the cap and cylinder, the electrical connection is effective and there is less risk of damage to the delicate filaments of the screens than with previous arrangements where contact is between sliding or rotating surfaces, which could cause severing. The construction of the present invention also enables the clamping force applied to the screening sleeves to be limited by selection of the size of the gap through which the screens are threaded. The screening sleeves are enclosed within the coupling nut so that they are protected from damage and so that any stray filaments are contained.

What I claim is:

1. A backshell assembly comprising: a first annular member having a plurality of castellations around one end forming a plurality of recesses and having locking teeth around its other end; a second annular member adapted to engage the one end of said first member, said second annular member having a plurality of projections shaped to extend within said recesses and form a gap between the recesses and the projections such that screening sleeves of cables extending within said first member can be threaded through said gaps; a body locked against rotation with said second annular member; a third annular member rotatably mounted at one end on said body and extending externally of said first member, said third annular member having a screw thread at an opposite end such that said third member can be screwed onto a fourth member to bring the said locking teeth on said first member into engagement with locking teeth on said fourth member and to apply a clamping force on said screening sleeves in said gaps, and wherein at least one of said first and second members is electrically conductive so that electrical connection is made to said screening sleeves.

2. An electrical connection comprising: a first annular member having a plurality of castellations around one end forming a plurality of recesses; a second annular member adapted to engage the said one end of said first member, the second annular member having a plurality of projections shaped to extend within said recesses; a third annular member extending externally of said first member and retaining said second annular member against said first annular member such that screening sleeves on cables extending within said first member can be threaded through said recesses to extend between an outside of said first member and an inside of said third member and are clamped in said recesses by said projections on said second member, and wherein at least one of said first and second members is electrically conductive.

3. An electrical connection according to claim 2, wherein said second annular member extends externally around said castellations, and wherein said projections are internally of said second member.

4. An electrical connection according to claim 2, wherein said first annular member is of a plastics material.

5. An electrical connection according to claim 2, wherein said second annular member is of a plastics material.

6. An electrical connection according to claim 2, wherein said first annular member is electrically conductive.

7. An electrical connection according to claim 6, wherein said first annular member is of a plastics with a layer of metal.

8. An electrical connection according to claim 2 including a body, wherein said body contacts one end of said second annular member, and wherein said third annular member is rotatable on said body.

9. An electrical connection according to claim 8, wherein said body and said one end of said second annular member have cooperating locking teeth.

10. An electrical connection according to claim 2, wherein said first and third members engage a fourth member at an end opposite said castellations.

11. An electrical connection according to claim 10, wherein said third member and said fourth member each have a screw thread, and wherein said screw thread on said third member engages the said screw thread on said fourth member.

12. An electrical connection according to claim 10, wherein said first member and said fourth member each have locking teeth, and wherein the locking teeth on said first member engage the locking teeth on said fourth member.

* * * * *